US008472818B2

(12) United States Patent
Yamane et al.

(10) Patent No.: US 8,472,818 B2
(45) Date of Patent: Jun. 25, 2013

(54) IMAGE CARRIER DETERIORATION DEGREE EVALUATING DEVICE, IMAGE CARRIER FAILURE PREDICTING DEVICE, AND IMAGE FORMING APPARATUS

(75) Inventors: Jun Yamane, Tokyo (JP); Yasushi Nakazato, Tokyo (JP); Kohji Ue, Tokyo (JP); Masahide Yamashita, Tokyo (JP); Mikiko Imazeki, Tokyo (JP); Yasuo Suzuki, Tokyo (JP); Michio Kimura, Tokyo (JP); Takaaki Ikegami, Tokyo (JP); Yoshiaki Kawasaki, Tokyo (JP); Hideo Nakamori, Tokyo (JP); Akihiro Sugino, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 302 days.

(21) Appl. No.: 12/929,204

(22) Filed: Jan. 7, 2011

(65) Prior Publication Data

US 2011/0170884 A1 Jul. 14, 2011

(30) Foreign Application Priority Data

Jan. 14, 2010 (JP) ..... 2010-006080

(51) Int. Cl.
*G03G 15/00* (2006.01)

(52) U.S. Cl.
USPC ..... 399/26

(58) Field of Classification Search
USPC ..... 399/24, 26, 31
See application file for complete search history.

(56) References Cited

U.S. PATENT DOCUMENTS

| | | | | |
|---|---|---|---|---|
| 8,019,239 | B2 * | 9/2011 | Nakayama et al. | 399/26 |
| 8,306,447 | B2 * | 11/2012 | Ogura | 399/73 |
| 2007/0258723 | A1 | 11/2007 | Nakazato et al. | |
| 2008/0075476 | A1 | 3/2008 | Nakazato et al. | |
| 2008/0199193 | A1 | 8/2008 | Nakazato et al. | |
| 2009/0052912 | A1 * | 2/2009 | Soji et al. | 399/31 |
| 2009/0190939 | A1 | 7/2009 | Satoh et al. | |
| 2009/0196634 | A1 | 8/2009 | Satoh et al. | |
| 2009/0322524 | A1 | 12/2009 | Nakazato et al. | |
| 2009/0324259 | A1 | 12/2009 | Ue et al. | |
| 2010/0094594 | A1 | 4/2010 | Yamashita et al. | |
| 2011/0004419 | A1 | 1/2011 | Ue et al. | |
| 2011/0007337 | A1 | 1/2011 | Imazeki et al. | |

FOREIGN PATENT DOCUMENTS

| | | |
|---|---|---|
| JP | 06-202405 | 7/1994 |
| JP | 2008-309973 | 12/2008 |
| JP | 4485759 | 4/2010 |

OTHER PUBLICATIONS

Abstract of JP 2005-017874 published on Jan. 20, 2005.

* cited by examiner

*Primary Examiner* — David Gray
*Assistant Examiner* — Gregory H Curran
(74) *Attorney, Agent, or Firm* — Harness, Dickey & Pierce, P.L.C.

(57) ABSTRACT

An image carrier deterioration degree evaluating apparatus for evaluating a degree of deterioration of an image carrier of an image forming apparatus, the image carrier deterioration degree evaluating apparatus including: an image deletion detecting unit that detects image deletion by obtaining latent image information written on the image carrier; an image deletion reducing unit that performs a process of reducing image deletion when the image deletion detecting unit detects image deletion, and an image carrier deterioration degree evaluating unit that drives the image deletion detecting unit and the image deletion reducing unit alternately one or more times each, and evaluates a degree of deterioration of the image carrier by using the latent image information obtained one or more times by the image deletion detecting unit.

7 Claims, 4 Drawing Sheets

MEASURING TIMES VS. Vdiff (N=5)

IMAGE CARRIER DETERIORATION DEGREE EVALUATING DEVICE, IMAGE CARRIER FAILURE PREDICTING DEVICE, AND IMAGE FORMING APPARATUS

CROSS-REFERENCE TO RELATED APPLICATIONS

The present application claims priority to and incorporates by reference the entire contents of Japanese Patent Application No. 2010-006080 filed in Japan on Jan. 14, 2010.

BACKGROUND OF THE INVENTION

1. Field of the Invention

The present invention generally relates to an image carrier deterioration degree evaluating device, an image carrier failure predicting device, and an image forming apparatus.

2. Description of the Related Art

Conventionally, when a failure occurs in various machines and apparatuses available in the market, users cannot use them until the repair thereof is completed and are forced to bear an inconvenience. Therefore, it is desirable that an occurrence of a failure be predicted and prevented before the failure actually occurs.

Accordingly, technologies to predict whether a failure occurs in a near future have been considered using an internal condition and an internal signal of a machine or apparatus. In particular, failure predicting technologies for hard disks in computers are in practical use and are widely used.

Although, several failure predicting technologies have been produced for an image forming apparatus such as a copying machine having a complex structure, a highly accurate failure predicting technology is not yet established and only a few have been practiced.

Presently, on the maintenance of such an imaging apparatus, maintenance referred to as preventive maintenance is performed. The preventive maintenance is a type of maintenance approach where maintenance is performed before a failure occurs to minimize a downtime of the apparatus. The preventive maintenance can be roughly divided into time based prevention maintenance and condition based prevention maintenance.

The time based prevention maintenance can be divided into periodic maintenance and age-based maintenance. In the periodic maintenance, a person responsible for the maintenance regularly diagnoses the target apparatus and performs maintenance when a sign of a failure is found. In the age-based maintenance, the maintenance is performed when a specified period of time has elapsed after the start of the use or after the last repair. In either case, a systematic maintenance is performed based on the time.

In the condition based prevention maintenance, the condition of the target apparatus is monitored and, when a sign of a failure is found, the maintenance is performed.

In any of these preventive maintenances, due to the maintenances being performed based on an empirical criterion, there is a failure that leads to a forcedly performed corrective maintenance may occur without being noticed even when the failure is about to occur actually. Also, there is a failure that a component that can still be used for a longer period of time may be replaced by judging from an empirical life expectancy, resulting in requiring a wasteful spending.

Accordingly, technologies to predict an occurrence of a failure by the failure predicting technologies described above have been proposed to perform maintenance before the failure occurs.

For example, Japanese Patent Application Laid-open No. 2005-17874 discloses a method of predicting abnormality occurrence, a state discriminating device, and an image forming apparatus.

The method obtains a plurality of kinds of information relating to the state of the image forming apparatus, calculates an index value D from the information thus obtained, and then determines changes in the state of the image forming apparatus based on the data of changes in the index value D calculated over time, thereby predicting an occurrence of a failure from the index value D.

Various other failure predicting technologies have been proposed, all of which perform prediction by discriminating whether the apparatus is in a predictive state of a failure based on a specified index value.

There have been numerous failure predicting technologies proposed for image forming apparatuses, however, in terms of practicability, prediction accuracy is yet to be sufficient. Therefore, an addition of a parameter highly correlative to the failure is desired.

Meanwhile, in an electrophotographic image forming apparatus such as a copying machine, a printer, and a facsimile, a phenomenon referred to as "image deletion" is known to occur. The mechanism of occurrence of the image deletion will now be explained.

In an electrophotographic image forming apparatus, prior to forming an electrostatic latent image on a surface of a photosensitive drum that is an electrostatic latent image carrier, the electrostatic latent image carrier is uniformly charged by a variety of methods. A method utilizing corona discharge is commonly used as the charging method.

However, this corona discharging method generates a large amount of ozone when discharging and requires a high-voltage power supply of about four to ten kilovolts.

In the case of charging devices by corona discharge, corona products such as nitrogen oxide (hereinafter, referred to as NOx) may be produced, which results in an adverse effect on image forming.

More specifically, starting a charging operation generates discharges that consequently form NOx. The NOx reacts with water in the air to produce nitric acid and reacts with metal also to produce metal nitrate.

When the nitric acid or the nitrate forms a thin film adhering on the surface of the electrostatic latent image carrier, an abnormal image in which a part of the image is deleted is produced in a high humidity environment.

The reason is that the resistance of the nitride acid or the nitrate becomes low due to their moisture absorption, whereby the electrostatic latent image formed on the surface of the electrostatic latent image carrier is destroyed. This phenomenon is referred to as image deletion.

In recent years, as disclosed in Japanese Patent Application Laid-open No. 2008-309973, such image deletion is detected and further, to prevent the image deletion, an image deletion reducing operation is performed in which a photosensitive drum is run idly or the moisture on the surface of the photosensitive drum is removed by using a heater.

However, it is known that, if the photosensitive drum itself deteriorates, the effect of the image deletion reducing operation is slow to appear due to unevenness of the surface of the photosensitive drum.

With respect to image forming apparatuses, a highly accurate failure predicting technology is desired to be made. Such a highly accurate failure predicting technology is expected to lead to a substantial reduction in downtime and a reduction in maintenance cost. Particularly, prediction for the failure of a photosensitive drum is important above all.

Various approaches in failure predicting technologies for a photosensitive drum have been proposed and developed for practical use. However, the accuracy is not yet sufficient.

Meanwhile, with a photosensitive drum of an electrophotography image forming apparatus, there is a phenomenon known as image deletion. This is a phenomenon likely to occur after a long time of non-use such as first thing in the morning, while it is not a failure. Various approaches have also been proposed to detect image deletion and to reduce image deletion (to recover from a state of image deletion).

However, it is known that, if the photosensitive drum starts to deteriorate, even with such image deletion recovering approaches, the recovered condition differs from that of a normal element.

SUMMARY OF THE INVENTION

It is an object of the present invention to at least partially solve the problems in the conventional technology.

According to an aspect of the present invention, there is provided an image carrier deterioration degree evaluating apparatus for evaluating a degree of deterioration of an image carrier of an image forming apparatus, the image carrier deterioration degree evaluating apparatus including: an image deletion detecting unit that detects image deletion by obtaining latent image information written on the image carrier; an image deletion reducing unit that performs a process of reducing image deletion when the image deletion detecting unit detects image deletion, and an image carrier deterioration degree evaluating unit that drives the image deletion detecting unit and the image deletion reducing unit alternately one or more times each, and evaluates a degree of deterioration of the image carrier by using the latent image information obtained one or more times by the image deletion detecting unit.

According to another aspect of the present invention, there is provided an image carrier failure predicting apparatus for predicting a failure of an image carrier of an image forming apparatus, the image carrier failure predicting apparatus including: an image deletion detecting unit that detects image deletion by obtaining latent image information written on the image carrier; an image deletion reducing unit that performs a process of reducing image deletion when the image deletion detecting unit detects image deletion, and a failure predicting unit that drives the image deletion detecting unit and the image deletion reducing unit alternately one or more times each, and predicts a failure of the image carrier by using the latent image information obtained one or more times by the image deletion detecting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT(S)

An exemplary embodiment of the invention will be described below with reference to accompanying drawings.

Figure 1:
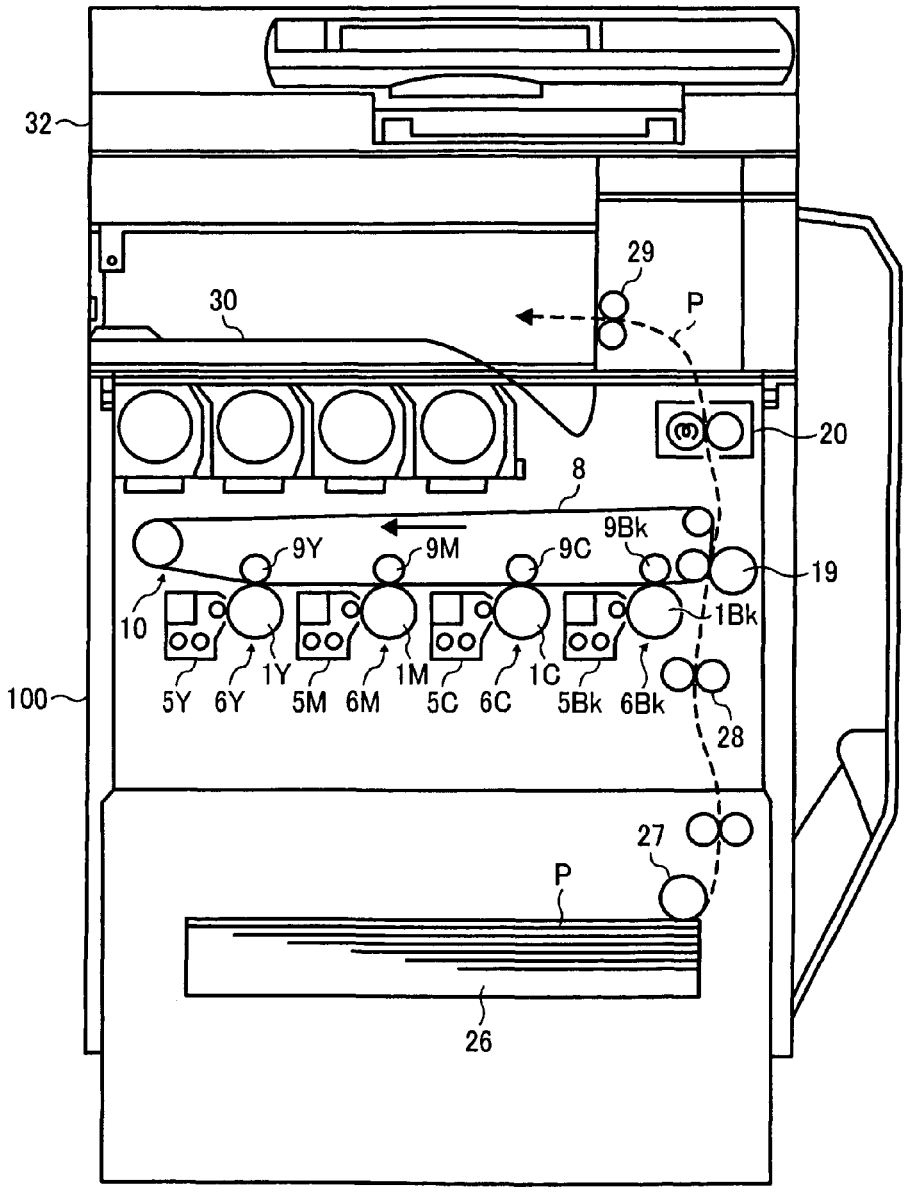
FIG. 1 is a schematic diagram illustrating a structure of an image forming apparatus according to an embodiment of the invention.

With reference to FIG. 1, a brief overview of the structure of an image forming apparatus according to an embodiment will be explained.

Facing the under surface of an intermediate transfer belt 8 as an unfixed image carrier of an intermediate transfer unit 10, image forming units 6Y, 6M, 6C, and 6Bk that correspond to respective colors (yellow, magenta, cyan, and black) are arranged in parallel. Except for the toner used in an image forming process being in a different color, the image forming units 6Y, 6M, 6C, and 6Bk have an identical structure.

Each of the image forming units 6 is structured with a photosensitive drum 1 as an image carrier, a charging unit not depicted and arranged in the periphery of the photosensitive drum 1, a developing unit 5, a cleaning unit not depicted, and the like.

On the photosensitive drum 1, the image forming process (charging process, exposing process, developing process, transferring process, and cleaning process) is performed and a desired toner image is formed on the photosensitive drum 1.

The photosensitive drum 1 is rotary driven by a driving unit not depicted in the clockwise direction in FIG. 1 and the surface of the photosensitive drum 1 is uniformly charged at the position of the charging unit (charging process).

The surface of the photosensitive drum 1 then reaches the radiating position of a laser beam radiated from an exposing unit not depicted and, at this position, an electrostatic latent image is formed by an exposure scanning on the photosensitive drum 1 (exposing process).

The surface of the photosensitive drum 1 reaches the position facing the developing unit 5 and, at this position, the electrostatic latent image is developed, whereby the desired toner image is formed (developing process).

The surface of the photosensitive drum 1 then reaches the position facing the intermediate transfer belt 8 and a primary transfer bias roller 9 and, at this position, the toner image on the photosensitive drum 1 is transferred onto the intermediate transfer belt 8 (primary transferring process).

The surface of the photosensitive drum 1 reaches the position facing the cleaning unit and, at this position, residual toner not transferred and remaining on the photosensitive drum 1 is recovered (cleaning process). After the cleaning, the electrical potential of the surface of the photosensitive drum 1 is initialized by a neutralization roller not depicted. This completes a series of image forming processes performed on the photosensitive drum 1.

The image forming process is performed by each of four image forming units 6Y, 6M, 6C, and 6Bk. More specifically, the laser beam based on image information is radiated towards the photosensitive drums of the respective image forming units 6Y, 6M, 6C, and 6Bk from the respective exposing units (optical write devices) not depicted and arranged below the image forming units. Thereafter, toner images of respective colors formed on the respective photosensitive drums after going through the developing process are transferred and superimposed onto the intermediate transfer belt 8. Consequently, a color image is formed on the intermediate transfer belt 8.

Four pieces of primary transfer bias rollers 9Y, 9M, 9C, and 9Bk form respective primary transfer nips by pinching the intermediate transfer belt 8 with the respective photosensitive drums 1Y, 1M, 1C, and 1Bk. To each of the primary transfer bias rollers 9Y, 9M, 9C, and 9Bk, a transfer bias of an opposite polarity to the polarity of the toner is applied.

The intermediate transfer belt 8 runs in the arrow direction and passes through the primary transfer nips of the respective primary transfer bias rollers 9Y, 9M, 9C, and 9Bk in sequence. Consequently, the toner images of the respective colors on the photosensitive drums 1Y, 1M, 1C, and 1Bk are primary transferred and superimposed onto the intermediate transfer belt 8.

Thereafter, the intermediate transfer belt 8, on which the superimposed toner images of the respective colors transferred, reaches the position facing a secondary transfer roller 19 as a secondary transfer unit. The color toner images formed on the intermediate transfer belt 8 are transferred onto a transfer sheet P as a recording medium, which is conveyed to the position of a secondary transfer nip.

This completes a series of transfer processes performed on the intermediate transfer belt 8.

An apparatus body 100 has a paper feeding unit 26 arranged in a lower portion thereof and storing a plurality of the transfer sheet P stacked. The transfer sheet P is separated and fed one sheet at a time by a paper feeding roller 27. The transfer sheet P fed is temporarily held by a pair of registration rollers 28 to have its skew corrected and is then conveyed towards the secondary transfer nip at a specified timing by the registration rollers 28. Then, as described above, the desired color image is transferred onto the transfer sheet P at the secondary transfer nip.

The transfer sheet P with the color image transferred at the position of the secondary transfer nip is conveyed to a fixing unit 20 where the transferred color image thereon is fixed to its surface by heat and pressure of a fixing roller and a pressure roller.

The transfer sheet P after fixing is discharged as an output image, by a pair of discharging rollers 29, to a discharging unit 30 formed on an upper portion of the apparatus body and is stacked thereon. Consequently, a series of image forming processes of the image forming apparatus is completed.

In FIG. 1, the reference numeral 32 represents a scanning unit.

Figure 2:
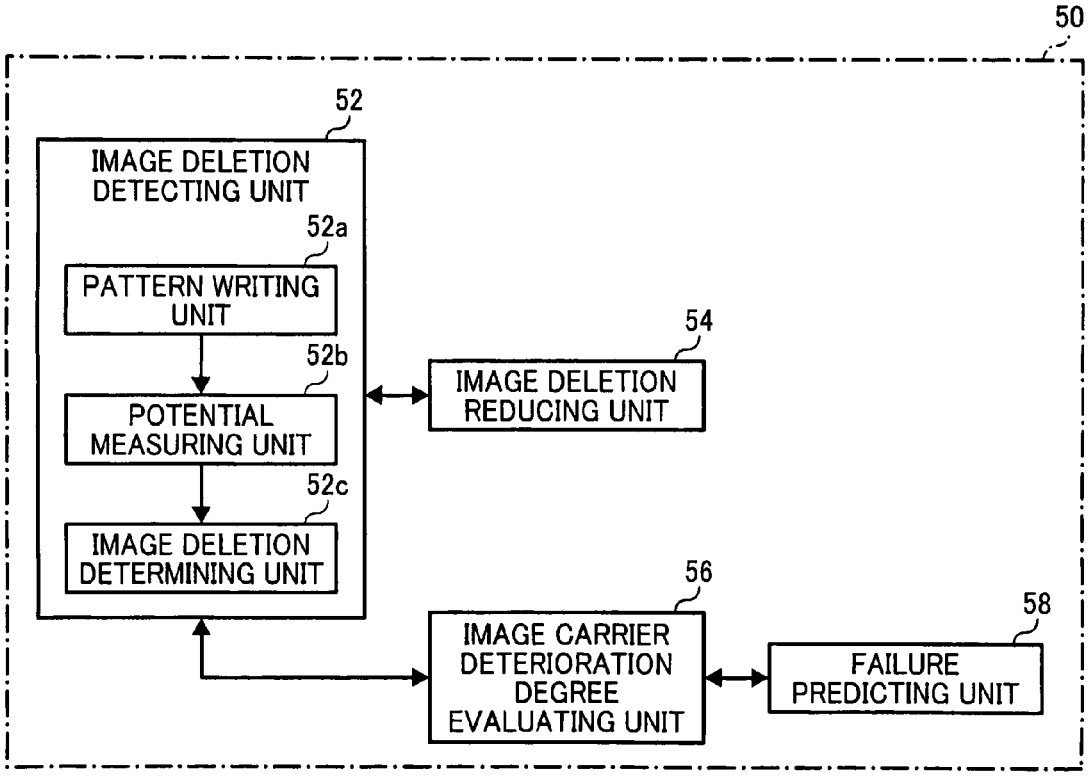
FIG. 2 is a control block diagram.

With reference to FIG. 2, an image carrier failure predicting device will be described. As illustrated in FIG. 2, this image carrier failure predicting apparatus 50 as a control unit includes an image deletion detecting unit 52, an image deletion reducing unit 54, an image carrier deterioration degree evaluating unit 56 as an image carrier deterioration degree evaluating device, and a failure predicting unit 58. Here, the image carrier failure predicting apparatus 50 is arranged in the apparatus body 100. Alternatively, the image carrier failure predicting apparatus 50 can be configured separately from the apparatus body 100.

The image deletion detecting unit 52 includes a pattern writing unit 52*a* that writes a designated pattern on the photosensitive drum 1 as the image carrier, a potential measuring unit 52*b* that measures and outputs a potential of the pattern written, and an image deletion determining unit 52*c* that determines whether image deletion is occurring based on the potential value measured by the potential measuring unit 52*b* and outputs its results.

The image deletion reducing unit 54 takes various approaches of, for example, idly running the photosensitive drum or activating a heater near the photosensitive drum to remove moisture on the surface of the photosensitive drum.

The detail of a failure predicting function of the image forming apparatus of the embodiment will now be described.

The operation of the image deletion detecting unit 52 will be explained. The pattern writing unit 52*a* draws the pattern on the photosensitive drum similarly to the image forming process for printing. Pattern data is stored in a ROM or the like of the control unit in advance and the pattern writing unit 52*a* controls the exposing unit based on the pattern data.

Figure 3:
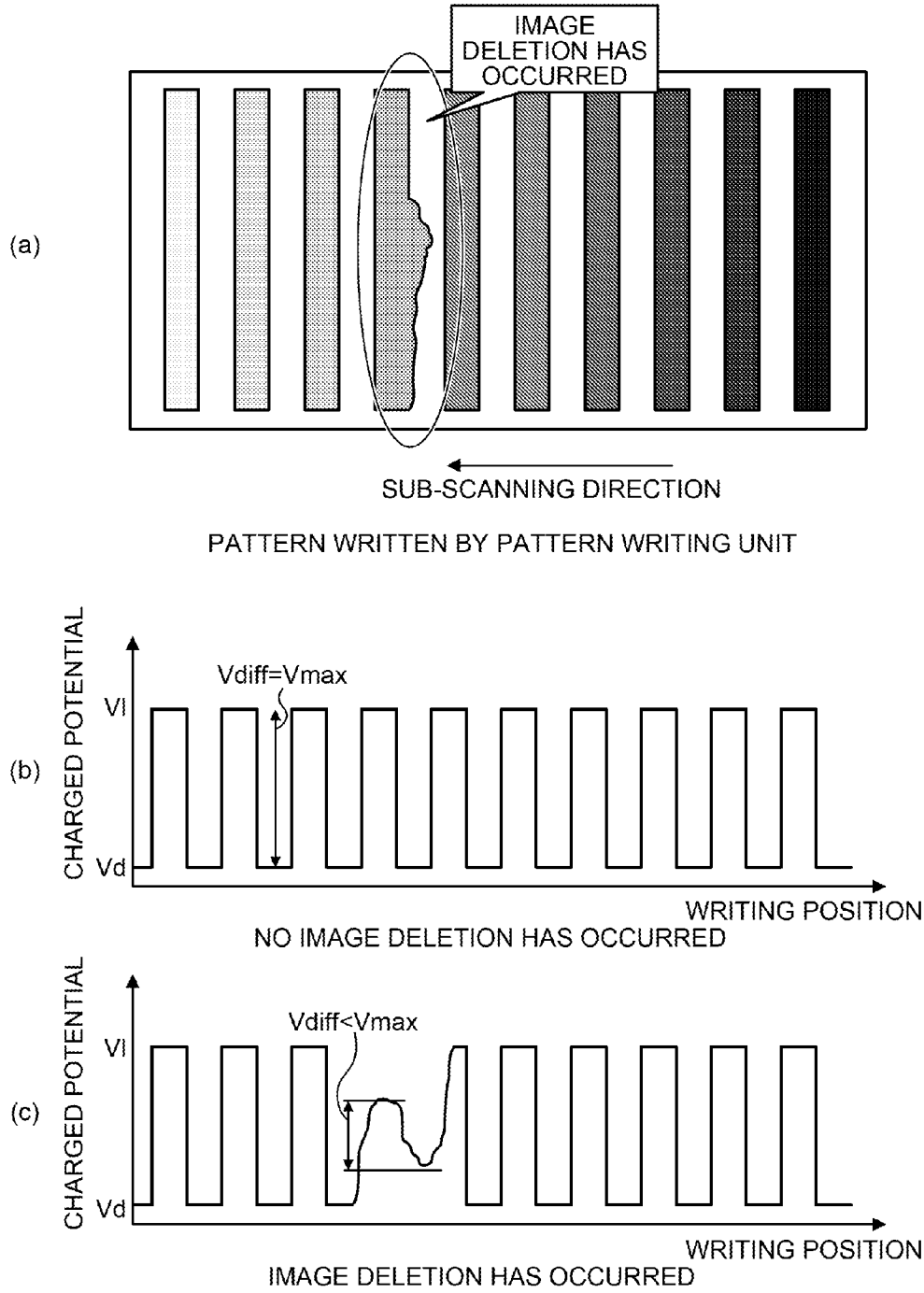
FIGS. 3A to 3C are diagrams illustrating a relation between a pattern and a potential waveform, FIG. 3A depicting the pattern, FIG. 3B illustrating a potential waveform with no image deletion, and FIG. 3C illustrating a potential waveform with image deletion occurring.

As for the pattern, the pattern indicated in FIG. 3 of Japanese Patent Application Laid-open No. 2008-309973 disclosed may be used or a pattern with black rectangles disposed in parallel at a specified interval as depicted in FIG. 3A may be used. The followings are discussed using the later pattern of black rectangles disposed in parallel at a specified interval. FIG. 3A is a planar development view of the rectangular pattern formed over the entire circumference of the photosensitive drum in the circumferential direction.

The potential measuring unit 52*b* measures a potential of the surface of the photosensitive drum. Because image deletion is distributed nearly uniformly in the axial direction of the photosensitive drum, it is only necessary to measure the image deletion at one point in the axial direction and for one full circle in the circumferential direction.

As for the latent image on the photosensitive drum, when the photosensitive drum is normal without image deletion, as indicated in FIG. 3B, the distribution of potentials has clear contrast (the difference Vdiff between a maximum value and a minimum value is nearly equal to the difference Vmax between the potential of a solid portion V1 and charged potential Vd) substantially according to the writing pattern. When image deletion occurs, as depicted in FIG. 3C, the contrast in waveform is collapsed in response to the image deletion.

The image deletion determining unit 52*c* determines whether image deletion is occurring using the potential value measured by the potential measuring unit 52*b*. The method of determination can include an approach that calculates the difference Vdiff between a maximum value and a minimum value of the potentials measured, and then compares the difference Vdiff with a predetermined threshold value Vthred. When the difference Vdiff is equal to or greater than the threshold value Vthred, it is determined that image deletion is not occurring. When the difference Vdiff is below the threshold value Vthred, image deletion is determined to be occurring. However, the method is not limited to this.

A surface potential measuring unit 52*b* is provided individually on each of the photosensitive drums of respective colors and the occurrence of image deletion is determined for each of the photosensitive drums.

The operation of the image carrier deterioration degree evaluating unit 56 will now be described.

The image carrier deterioration degree evaluating unit 56 activates the image deletion detecting unit 52 to measure the Vdiff, and then activates the image deletion reducing unit 54.

The image carrier deterioration degree evaluating unit 56 further activates the image deletion detecting unit 52 to measure the Vdiff. Thus, the image carrier deterioration degree evaluating unit 56 alternately activates the image deletion detecting unit 52 and the image deletion reducing unit 54. The image deletion detecting unit 52 is activated for N+1 times and the image deletion reducing unit 54 is activated for N times in total. An optimum value of the number of times N varies depending on the image forming apparatus and needs to be determined by a preliminary experiment. The following is discussed under a condition of N=5.

Figure 4:
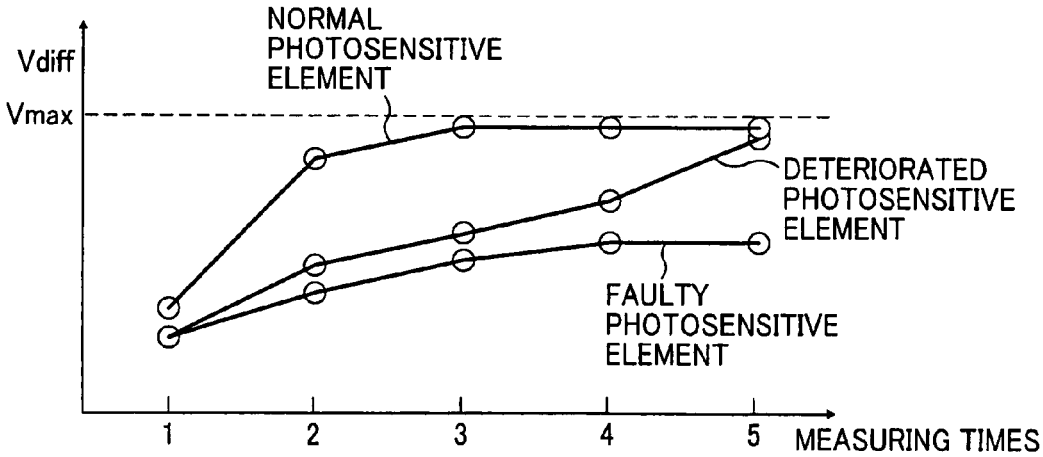
FIG. 4 is a chart of experimental characteristics illustrating the relation of the number of measuring times and Vdiff (difference between a maximum value and a minimum value of the potential waveform).

FIG. 4 is an example of the Vdiff (Vdiff(x)) plotted corresponding to the number of measuring times x ($0 \ll x \ll N$). As indicated in FIG. 4, generally, the Vdiff comes closer to the Vmax when the number of measuring times x increases.

However, as discussed above, when the photosensitive drum deteriorates, although the Vdiff ultimately reaches the Vmax after the photosensitive drum is recovered from a state of image deletion, it takes longer to come close.

When the photosensitive drum is faulty, because it cannot be recovered, the Vdiff does not come close to the Vmax regardless of how many times the image deletion reducing unit 54 is activated.

Accordingly, the degree of the Vdiff(x) coming close to the Vmax can be assumed as the degree of recovery of the photosensitive drum. Thus, the degree of Vdiff(x) coming close to the Vmax, i.e., the degree of recovery of the photosensitive drum, can be used to estimate the degree of deterioration of the photosensitive drum.

An approach to concretely evaluate the degree of Vdiff(x) coming close to the Vmax includes the use of a value of Vdiff (Vdiff(M)) or Vdiff(M)/Vmax at x=M(M<N).

It can be determined that the greater the value is, the closer the Vdiff is coming to the Vmax, i.e., the degree of recovery of the photosensitive drum is greater.

An alternative approach to concretely evaluate the degree of Vdiff(x) coming close to the Vmax includes the use of a value of time integration of the Vdiff(x) at each x ($\Sigma$Vdiff(x)) or a ratio of this value to Vmax×N. It can be determined that the greater the value is, the closer the Vdiff is coming to the Vmax, i.e., the degree of recovery of the photosensitive drum is greater.

The operation of the failure predicting unit 58 will now be described.

The failure predicting unit 58 predicts a failure of the image carrier by discriminating a sign of the failure using the degree of deterioration.

There have been various approaches proposed to statistically predict a failure. Japanese Patent Application Laid-open No. 2005-17874 (METHOD OF PREDICTING ABNORMALITY OCCURRENCE, STATE DISCRIMINATING DEVICE, AND IMAGE FORMING APPARATUS) discloses an approach to discriminate a sign of a failure of the image forming apparatus using a statistical approach. The failure predicting unit 58 can use this approach with an addition of values, as parameters used for the discrimination, such as each of the degrees of deterioration described above, a value of the Vdiff at each number of measuring times x, and a difference thereof (Vdiff(x)−Vdiff(x−1)), thereby improving the accuracy of prediction.

Incidentally, it can be configured such that the operation of the image carrier deterioration degree evaluating unit 56 is performed by the failure predicting unit 58.

According to the present invention, a failure of the image carrier can be predicted highly accurately, and a substantial reduction in downtime and a reduction in maintenance cost can be realized.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image carrier deterioration degree evaluating apparatus for evaluating a degree of deterioration of an image carrier of an image forming apparatus, the image carrier deterioration degree evaluating apparatus comprising:

an image deletion detecting unit that detects image deletion by obtaining latent image information written on the image carrier;

an image deletion reducing unit that performs a process of reducing image deletion when the image deletion detecting unit detects image deletion, and an image carrier deterioration degree evaluating unit that drives the image deletion detecting unit and the image deletion reducing unit alternately one or more times each, and evaluates a degree of deterioration of the image carrier by using the latent image information obtained one or more times by the image deletion detecting unit.

2. The image carrier deterioration degree evaluating apparatus according to claim 1, wherein the image carrier deterioration degree evaluating unit obtains a degree of recovery from a state of image deletion from the latent image information obtained by the image deletion detecting unit, and evaluates the degree of deterioration of the image carrier by using the degree of recovery.

3. The image carrier deterioration degree evaluating apparatus according to claim 2, wherein the image carrier deterioration degree evaluating unit evaluates the degree of deterioration of the image carrier by using a time integration value of the degree of recovery.

4. An image forming apparatus comprising the image carrier deterioration degree evaluating apparatus according to claim 1.

5. An image carrier failure predicting apparatus for predicting a failure of an image carrier of an image forming apparatus, the image carrier failure predicting apparatus comprising:

an image deletion detecting unit that detects image deletion by obtaining latent image information written on the image carrier;

an image deletion reducing unit that performs a process of reducing image deletion when the image deletion detecting unit detects image deletion, and a failure predicting unit that drives the image deletion detecting unit and the image deletion reducing unit alternately one or more times each, and predicts a failure of the image carrier by using the latent image information obtained one or more times by the image deletion detecting unit.

6. The image carrier failure predicting apparatus according to claim 5, wherein the failure predicting unit obtains a degree of recovery from a state of image deletion from the latent image information obtained by the image deletion detecting unit, and predicts a failure of the image carrier by using the degree of recovery.

7. The image carrier failure predicting apparatus according to claim 6, wherein the failure predicting unit predicts a failure of the image carrier by using a time integration value of the degree of recovery.

* * * * *